US007766982B2

(12) United States Patent
Colucci et al.

(10) Patent No.: US 7,766,982 B2
(45) **Date of Patent: *Aug. 3, 2010**

(54) FUELS COMPOSITIONS AND METHODS FOR USING SAME

(75) Inventors: William J. Colucci, Glen Allen, VA (US); John T. Loper, Richmond, VA (US); Allen A. Aradi, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 1157 days.

This patent is subject to a terminal disclaimer.

(21) Appl. No.: 11/396,851

(22) Filed: Apr. 3, 2006

(65) Prior Publication Data

US 2006/0168876 A1 Aug. 3, 2006

Related U.S. Application Data

(62) Division of application No. 10/670,552, filed on Sep. 25, 2003, now Pat. No. 7,491,248.

(51) Int. Cl.
*C10L 1/18* (2006.01)
*C10L 1/22* (2006.01)

(52) U.S. Cl. ..... 44/347; 44/359; 44/415

(58) Field of Classification Search ..... 44/418, 44/359, 415, 347

See application file for complete search history.

(56) References Cited

U.S. PATENT DOCUMENTS

| | | | | |
|---|---|---|---|---|
| 2,425,755 | A | 8/1947 | Roberts et al. | |
| 2,425,845 | A | 8/1947 | Toussaint et al. | |
| 2,448,664 | A | 9/1948 | Fife et al. | |
| 2,457,139 | A | 12/1948 | Fife et al. | |
| 3,849,085 | A | 11/1974 | Kreuz et al. | |
| 4,152,499 | A | 5/1979 | Boerzel et al. | |
| 4,231,759 | A | 11/1980 | Udelhofen et al. | |
| 4,238,628 | A | 12/1980 | Cahill et al. | |
| 4,288,612 | A | 9/1981 | Lewis et al. | |
| 4,388,198 | A * | 6/1983 | Butcosk | 508/136 |
| 4,877,416 | A | 10/1989 | Campbell | |
| 5,089,029 | A | 2/1992 | Hashimoto et al. | |
| 5,112,364 | A | 5/1992 | Rath et al. | |
| 5,300,701 | A | 4/1994 | Cherpeck | |
| 5,503,644 | A | 4/1996 | Graiff et al. | |
| 5,514,190 | A | 5/1996 | Cunningham et al. | |
| 5,522,906 | A | 6/1996 | Hashimoto et al. | |
| 5,567,211 | A | 10/1996 | Russo et al. | |
| 5,634,951 | A | 6/1997 | Colucci et al. | |
| 5,697,988 | A | 12/1997 | Malfer et al. | |
| 5,725,612 | A | 3/1998 | Malfer et al. | |
| 5,755,835 | A | 5/1998 | Cherpeck | |
| 5,814,111 | A | 9/1998 | Graham et al. | |
| 5,873,917 | A | 2/1999 | Daly | |
| 5,876,468 | A | 3/1999 | Moreton | |
| 6,048,373 | A | 4/2000 | Malfer et al. | |
| 6,548,458 | B2 * | 4/2003 | Loper | 508/291 |
| 7,491,248 | B2 * | 2/2009 | Colucci et al. | 44/331 |
| 2002/0091068 | A1 | 7/2002 | Loper | |
| 2003/0056431 | A1 | 3/2003 | Schwab et al. | |
| 2003/0177692 | A1 | 9/2003 | Arters | |

FOREIGN PATENT DOCUMENTS

| | | |
|---|---|---|
| DE | 29 04 314 | 8/1980 |
| EP | 1132455 A1 | 3/2000 |
| EP | 1293553 A2 | 3/2003 |
| EP | 1295933 A2 | 3/2003 |
| EP | 1 411 105 A2 | 4/2004 |
| WO | 01/42398 A1 | 6/2001 |

OTHER PUBLICATIONS

Tupa et al., "Gasoline Port Fuel Injectors—Keep Clean with Additives," SAE Technical Paper 861536; Oct. 6, 1986.

Abramo et al., "Port Fuel Injector Cleanliness Studies," SAE Technical Paper 861535; Oct. 6, 1986.

ASTM Standard Test Method for Evaluating Unleaded Automotive Spark-Ignition Engine Fuel for Electronic Port Fuel Injector Fouling, D5598-95a; Oct. 1995.

Austrian Search Report and Written Opinion mailed Aug. 11, 2006 Application No. 200405335-1.

Chinese Office Action dated Apr. 14, 2010; Serial No. 200910134226.X; 8 pages.

* cited by examiner

*Primary Examiner*—Cephia D Toomer
(74) *Attorney, Agent, or Firm*—Thomas, Karceski, Raring & Teague, PC

(57) ABSTRACT

A fuel composition and methods for using it for controlling deposit formation in a spark-ignition internal combustion engine, such as a direct injection engine, comprising a spark-ignition fuel, a detergent, and a deposit inhibitor compound.

2 Claims, No Drawings

FUELS COMPOSITIONS AND METHODS FOR USING SAME

This application is a divisional of U.S. patent application Ser. No. 10/670,552 filed on Sep. 25, 2003, now U.S. Pat. No. 7,491,248.

FIELD OF THE INVENTION

The present invention relates to new spark-ignition fuel compositions and methods for controlling, i.e. reducing or eliminating, injector deposits and reducing soot formation in spark-ignition internal combustion engines. More particularly, the invention relates to fuel compositions comprising a spark-ignition fuel and a combination of a detergent and a deposit inhibitor compound, which can be a succinimide compound and/or a manganese compound, and the use of said fuel compositions in direct injection gasoline (DIG) engines.

BACKGROUND OF THE INVENTION

Over the years considerable work has been devoted to additives for controlling (preventing or reducing) deposit formation in the fuel induction systems of spark-ignition internal combustion engines. In particular, additives that can effectively control fuel injector deposits, intake valve deposits and combustion chamber deposits represent the focal point of considerable research activities in the field and despite these efforts, further improvements are desired.

DIG technology is currently on a steep developmental curve because of its high potential for improved fuel economy and power. Environmentally, the fuel economy benefits translate directly into lower carbon dioxide emissions, a greenhouse gas that is contributing to global warming.

However, direct injection gasoline engines can encounter problems different from those of the conventional engines due to the direct injection of gasoline into the combustion chamber.

One of the major obstacles in DIG engine development was spark plug fouling. A narrow spacing configuration, where the fuel injector sat close to the spark plug, allowed easy fuel ignition as the fuel directly hit the plug. This caused soot to accumulate on the plug, eventually leading to fouling.

Another problem is related to the smoke exhausted mainly from the part of the mixture in which the gasoline is excessively rich, upon the stratified combustion. The amount of soot produced is greater than that of a conventional MPI engine, thus a greater amount of soot can enter the lubricating oil through combustion gas blow by.

Current generation DIG technologies have experienced deposit problems. Areas of concern are fuel rails, injectors, combustion chamber (CCD), crankcase soot loadings, and intake valves (IVD). Deposits in the intake manifold come in through the PCV valve and exhaust gas recirculation (EGR). Since there is no liquid fuel wetting the back of the intake valves, these deposits build up quite quickly.

However, as different engine types enter service worldwide, a fuel to power not only traditional multi-port fuel injected engines, but also gasoline direct injection engines will be required. The additives which work well as detergents in MPI engines will not necessarily work well in GDI engines, and as such additional detergents prepared especially for DIG engines may be required as a "top-treat" type additive or as an after-market fuel supplement.

There are numerous references teaching fuel compositions containing detergent compounds such as U.S. Pat. No. 4,231,759, or blends of detergents, for example U.S. Pat. Nos. 5,514,190, 5,522,906, and 5,567,211. There are also references teaching fuel compositions containing succinimide compounds, for example, U.S. Pat. No. 6,548,458 B2, but not in combination with detergents. There are also references teaching fuel compositions containing polyamines, polyethers, or polyetheramines, for example, U.S. Pat. Nos. 5,089,029, 5,112,364, and 5,503,644, but not in combination with dispersants such as succinimide. Nor do any of these references teach the use of fuel compositions containing Mannich base or polyetheramine detergents in combination with succinimide compounds in direct injection gasoline engines or the impact the combination of these compounds has on deposits in these engines.

SUMMARY OF THE INVENTION

The present invention is directed in an embodiment to fuel compositions comprising a spark-ignition internal combustion fuel, a detergent, and a deposit inhibitor compound, which when included in the fuel composition, results in reduced injector deposits and/or reduces soot formation in spark-ignition internal combustion engines, especially in DIG engines, in which the fuel composition is combusted as compared to the fuel composition devoid of the deposit inhibitor compound. It will be appreciated that the terminology "deposit inhibitor compound" can be a compound, the presence of which in the fuel composition, directly or indirectly results in controlled, i.e., reduced or eliminated, deposits and/or soot formation in the engine. The deposit inhibitor compound can be a succinimide dispersant, a manganese compound, or a combination of both.

In one embodiment, the present invention is directed to a fuel composition comprising (a) a spark-ignition internal combustion fuel; (b) a succinimide dispersant; and (c) a detergent. Further, this invention is directed to methods of controlling injector deposits in spark-ignition internal combustion engines, such as DIG engines.

In another embodiment, the invention is directed to a fuel composition comprising a spark-ignition fuel and a combination of a detergent and a manganese compound, and the use of said fuel compositions in deposits in spark-ignition internal combustion engines, such as DIG engines.

More broadly, the invention relates to a fuel composition comprising gasoline and a Mannich detergent wherein the fuel has been top-treated with a small amount of a succinimide dispersant.

DETAILED DESCRIPTION OF EMBODIMENTS

The detergent useful in the present invention can be selected from Mannich base detergents, polyetheramines, and combinations thereof.

Mannich Base Detergent:

The Mannich base detergents useful in embodiments of the present invention are the reaction products of an alkyl-substituted hydroxy aromatic compound, aldehydes and amines. The alkyl-substituted hydroxyaromatic compound, aldehydes and amines used in making the Mannich reaction products of the present invention may be any such compounds known and applied in the art, in accordance with the foregoing limitations.

Representative alkyl-substituted hydroxyaromatic compounds that may be used in forming the present Mannich base products are polypropylphenol (formed by alkylating phenol with polypropylene), polybutylphenols (formed by alkylating phenol with polybutenes and/or polyisobutylene), and polybutyl-co-polypropylphenols (formed by alkylating phenol with a copolymer of butylene and/or butylene and propylene). Other similar long-chain alkylphenols may also be used. Examples include phenols alkylated with copolymers of butylene and/or isobutylene and/or propylene, and one or more mono-olefinic comonomers copolymerizable therewith (e.g., ethylene, 1-pentene, 1-hexene, 1-octene, 1-decene, etc.) where the copolymer molecule contains at least 50% by weight, of butylene and/or isobutylene and/or propylene units. The comonomers polymerized with propylene or such butenes may be aliphatic and can also contain non-aliphatic groups, e.g., styrene, o-methylstyrene, p-methylstyrene, divinyl benzene and the like. Thus in any case the resulting polymers and copolymers used in forming the alkyl-substituted hydroxyaromatic compounds are substantially aliphatic hydrocarbon polymers.

In one embodiment herein, polybutylphenol (formed by alkylating phenol with polybutylene) is used in forming the Mannich base detergent. Unless otherwise specified herein, the term "polybutylene" is used in a generic sense to include polymers made from "pure" or "substantially pure" 1-butene or isobutene, and polymers made from mixtures of two or all three of 1-butene, 2-butene and isobutene. Commercial grades of such polymers may also contain insignificant amounts of other olefins. So-called high reactivity polybutylenes having relatively high proportions of polymer molecules having a terminal vinylidene group, formed by methods such as described, for example, in U.S. Pat. No. 4,152,499 and W. German Offenlegungsschrift 29 04 314, are also suitable for use in forming the long chain alkylated phenol reactant.

The alkylation of the hydroxyaromatic compound is typically performed in the presence of an alkylating catalyst at a temperature in the range of about 50 to about 200° C. Acidic catalysts are generally used to promote Friedel-Crafts alkylation. Typical catalysts used in commercial production include sulphuric acid, $BF_3$, aluminum phenoxide, methanesulphonic acid, cationic exchange resin, acidic clays and modified zeolites.

The long chain alkyl substituents on the benzene ring of the phenolic compound are derived from polyolefin having a number average molecular weight (MW of from about 500 to about 3000 (preferably from about 500 to about 2100) as determined by gel permeation chromatography (GPC). It is also preferred that the polyolefin used have a polydispersity (weight average molecular weight/number average molecular weight) in the range of about 1 to about 4 (preferably from about 1 to about 2) as determined by GPC.

The chromatographic conditions for the GPC method referred to throughout the specification are as follows: 20 micro L of sample having a concentration of approximately 5 mg/mL (polymer/unstabilized tetrahydrofuran solvent) is injected into 1000 A, 500 A and 100 A columns at a flow rate of 1.0 mL/min. The run time is 40 minutes. A Differential Refractive Index detector is used and calibration is relative to polyisobutene standards having a molecular weight range of 284 to 4080 Daltons.

The Mannich detergent may be made from a long chain alkylphenol. However, other phenolic compounds may be used including high molecular weight alkyl-substituted derivatives of resorcinol, hydroquinone, catechol, hydroxydiphenyl, benzylphenol, phenethylphenol, naphthol, tolylnaphthol, among others. Preferred for the preparation of the Mannich condensation products are the polyalkylphenol and polyalkylcresol reactants, e.g., polypropylphenol, polybutylphenol, polypropylcresol and polybutylcresol, wherein the alkyl group has a number average molecular weight of about 500 to about 2100, while the most preferred alkyl group is a polybutyl group derived from polybutylene having a number average molecular weight in the range of about 800 to about 1300.

The preferred configuration of the alkyl-substituted hydroxyaromatic compound is that of a para-substituted mono-alkylphenol or a para-substituted mono-alkyl orthocresol. However, any alkylphenol readily reactive in the Mannich condensation reaction may be employed. Thus, Mannich products made from alkylphenols having only one ring alkyl substituent, or two or more ring alkyl substituents are suitable for use in this invention. The long chain alkyl substituents may contain some residual unsaturation, but in general, are substantially saturated alkyl groups.

Representative amine reactants include, but are not limited to, linear, branched or cyclic alkylene monoamines or polyamines having at least one suitably reactive primary or secondary amino group in the molecule. Other substituents such as hydroxyl, cyano, amido, etc., can be present in the amine. In a preferred embodiment, the alkylene polyamine is a polyethylene polyamine. Suitable alkylene polyamine reactants include ethylenediamine, diethylenetriamine, triethylenetetramine, tetraethylenepentamine, pentaethylenehexamine, hexaethyleneheptamine, heptaethyleneoctamine, octaethylenenonamine, nonaethylenedecamine, decaethyleneundecamine and mixtures of such amines having nitrogen contents corresponding to alkylene polyamines of the formula $H_2N—(A—NH—)_nH$, where A is divalent ethylene or propylene and n is an integer of from 1 to 10. The alkylene polyamines may be obtained by the reaction of ammonia and dihaloalkanes, such as dichloro alkanes. Thus, the alkylene polyamines obtained from the reaction of 2 to 11 moles of ammonia with 1 to 10 moles of dichloro alkanes having 2 to 6 carbon atoms and the chlorines on different carbon atoms are suitable alkylene polyamine reactants.

In another preferred embodiment of the present invention, the amine is an aliphatic linear, branched or cyclic diamine having one primary or secondary amino group and one tertiary amino group in the molecule. Examples of suitable polyamines include N,N,N",N"-tetraalkyl-dialkylenetriamines (two terminal tertiary amino groups and one central secondary amino group), N,N,N',N"-tetraalkyltrialkylenetetramines (one terminal tertiary amino group, two internal tertiary amino groups and one terminal primary amino group), N,N,N',N",N'"-pentaalkyltrialkylene-tetramines (one terminal tertiary amino group, two internal tertiary amino groups and one terminal secondary amino group), N,N-dihydroxyalkyl-alpha, omega-alkylenediamines (one terminal tertiary amino group and one terminal primary amino group), N,N,N'-trihydroxy-alkyl-alpha, omega-alkylenediamines (one terminal tertiary amino group and one terminal secondary amino group), tris(dialkylaminoalkyl)aminoalkylmethanes (three terminal tertiary amino groups and one terminal primary amino group), and like compounds, wherein the alkyl groups are the same or different and typically contain no more than about 12 carbon atoms each, and which preferably contain from 1 to 4 carbon atoms each. Most preferably these alkyl groups are methyl and/or ethyl groups. Preferred polyamine reactants are N,N-dialkyl-alpha, omega-alkylenediamine, such as those having from 3 to about 6 carbon atoms in the alkylene group and from 1 to about 12 carbon atoms in each of the alkyl groups, which most preferably are the same but which can be different. Most preferred is N,N-dimethyl-1,3-propanediamine and N-methyl piperazine.

Examples of polyamines having one reactive primary or secondary amino group that can participate in the Mannich condensation reaction, and at least one sterically hindered amino group that cannot participate directly in the Mannich condensation reaction to any appreciable extent include N-(tert-butyl)-1,3-propanediamine, N-neopentyl-1,3-propanediamine, N-(tert-butyl)-1-methyl-1,2-ethanediamine, N-(tert-butyl)-1-methyl-1,3-propanediamine, and 3,5-di (tert-butyl)aminoethy-1-piperazine.

Representative aldehydes for use in the preparation of the Mannich base products include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The condensation reaction among the alkylphenol, the specified amine(s) and the aldehyde may be conducted at a temperature in the range of about 40° to about 200° C. The reaction can be conducted in bulk (no diluent or solvent) or in a solvent or diluent. Water is evolved and can be removed by azeotropic distillation during the course of the reaction. Typically, the Mannich reaction products are formed by reacting the alkyl-substituted hydroxyaromatic compound, the amine and aldehyde in the molar ratio of 1.0:0.5-2.0:1.0-3.0, respectively.

Suitable Mannich base detergents for use in the present invention include those detergents taught in U.S. Pat. Nos. 4,231,759; 5,514,190; 5,634,951; 5,697,988; 5,725,612; and 5,876,468, the disclosures of which are incorporated herein by reference.

When formulating the fuel compositions of this invention, the Mannich base detergent and the succinimide (with our without other additives) are employed in amounts sufficient to reduce or eliminate injector deposits. Thus the fuels will contain minor amounts of the Mannich base detergent and of the succinimide proportioned so as to prevent or reduce formation of engine deposits, especially fuel injector deposits, and most especially injector deposits in spark-ignition internal combustion engines. Generally speaking the fuel compositions of this invention will contain on an active ingredient basis an amount of Mannich base detergent in the range of about 5 to about 100 ptb (pounds by weight of additive per thousand barrels by volume of fuel), and preferably in the range of about 10 to about 80 ptb. The fuel compositions of the invention will in one embodiment contain from about 0.1 to about 40 ptb, and preferably in the range of about 1 to about 15 ptb, succinimide. In another embodiment, the Mannich/succinimide ratio is from 0.1:1 to 1000:1 by weight, or 0.5:1 to 100:1, or 1:1 to 80:1.

Polyetheramine Detergent:

Preparation of polyetheramine compounds useful as the detergent of the present invention is described in the literature, for example, U.S. Pat. No., the disclosure of which is incorporated herein in its entirety.

When formulating the fuel compositions of this invention, the polyetheramine compounds are employed in amounts sufficient to reduce or inhibit deposit and/or soot formation in a direct injection gasoline engine.

Polyetheramines suitable for use as the detergents of the present invention are "single molecule" additives, incorporating both amine and polyether functionalities within the same molecule. The polyether backbone can in one embodiment herein be based on propylene oxide, ethylene oxide, butylene oxide, or mixtures of these. In another embodiment, propylene oxide or butylene oxide or mixtures thereof are used to impart good fuel solubility. The polyetheramines can be monoamines, diamines or triamines. Examples of commercially available polyetheramines are those under the tradename Jeffamines™ available from Huntsman Chemical Company. The molecular weight of the polyetheramines will typically range from 500 to 3000. Other suitable polyetheramines are those compounds taught in U.S. Pat. Nos. 4,288,612; 5,089,029; and 5,112,364, incorporated herein by reference.

Deposit Inhibitor Compound:

Succinimide:

The succinimides suitable for use in the present embodiments impart a dispersant effect on the fuel composition when added in an amount effective for that purpose. The presence of the succinimide, together with the detergent, in the fuel composition is observed to result in controlled deposit formation not otherwise achieved in the absence of the succinimide. Therefore, the inclusion of the succinimide directly or indirectly results in the fuel composition having a property or properties more conducive to inhibiting the formation of engine deposits, especially injection valve deposits. Insofar as the combined amount of detergent and succinimide added to the fuel composition, in one embodiment herein the succinimide ingredient is the minor component and the detergent is the major component.

The succinimides, for example, include alkenyl succinimides comprising the reaction products obtained by reacting an alkenyl succinic anhydride, acid, acid-ester or lower alkyl ester with an amine containing at least one primary amine group. Representative non-limiting examples are given in U.S. Pat. Nos. 3,172,892; 3,202,678; 3,219,666; 3,272,746, 3,254,025, 3,216,936, 4,234,435; and 5,575,823. The alkenyl succinic anhydride may be prepared readily by heating a mixture of olefin and maleic anhydride to about 180-220° C. The olefin is, in an embodiment, a polymer or copolymer of a lower monoolefin such as ethylene, propylene, isobutene and the like. In another embodiment the source of alkenyl group is from polyisobutene having a molecular weight up to 10,000 or higher. In another embodiment the alkenyl is a polyisobutene group having a molecular weight of about 500-5,000 and most preferably about 700-2,000.

Amines which may be employed include any that have at least one primary amine group which can react to form an imide group. A few representative examples are: methylamine, 2-ethylhexylamine, n-dodecylamine, stearylamine, N,N-dimethyl-propanediamine, N-(3-aminopropyl)morpholine, N-dodecyl propanediamine, N-aminopropyl piperazine ethanolamine, N-ethanol ethylene diamine and the like. Preferred amines include the alkylene polyamines such as propylene diamine, dipropylene triamine, di-(1,2-butylene)-triamine, tetra-(1,2-propylene)pentaamine.

In one embodiment the amines are the ethylene polyamines that have the formula $H_2N(CH_2CH_2NH)_nH$ wherein n is an integer from one to ten. These ethylene polyamines include ethylene diamine, diethylene triamine, triethylene tetraamine, tetraethylene pentaamine, pentaethylene hexaamine, and the like, including mixtures thereof in which case n is the average value of the mixture. These ethylene polyamines have a primary amine group at each end so can form mono-alkenylsuccinimides and bis-alkenylsuccinimides.

Thus ashless dispersants for use in the present invention also include the products of reaction of a polyethylenepolyamine, e.g. triethylene tetramine or tetraethylene pentamine, with a hydrocarbon substituted carboxylic acid or anhydride made by reaction of a polyolefin, such as polyisobutene, having a molecular weight of 500 to 5,000, especially 700 to 2000, with an unsaturated polycarboxylic acid or anhydride, e.g. maleic anhydride.

Also suitable for use as the succinimides of the present invention are succinimide-amides prepared by reacting a succinimide-acid with a polyamine or partially alkoxylated polyamine, as taught in U.S. Pat. No. 6,548,458. The succinimide-acid compounds of the present invention are prepared by reacting an alpha-omega amino acid with an alkenyl or alkyl-substituted succinic anhydride in a suitable reaction media. Suitable reaction media include, but are not limited to, an organic solvent, such as toluene, or process oil. Water is a by-product of this reaction. The use of toluene allows for azeotropic removal of water.

The mole ratio of maleic anhydride to olefin can vary widely. It may vary, in one example, from 5:1 to 1:5, and in another example the range is 3:1 to 1:3 and in yet another embodiment the maleic anhydride is used in stoichiometric excess, e.g. 1.1 to 5 moles maleic anhydride per mole of olefin. The unreacted maleic anhydride can be vaporized from the resultant reaction mixture.

The alkyl or alkenyl-substituted succinic anhydrides may be prepared by the reaction of maleic anhydride with the desired polyolefin or chlorinated polyolefin, under reaction conditions well known in the art. For example, such succinic anhydrides may be prepared by the thermal reaction of a polyolefin and maleic anhydride, as described, for example in U.S. Pat. Nos. 3,361,673 and 3,676,089. Alternatively, the substituted succinic anhydrides can be prepared by the reaction of chlorinated polyolefins with maleic anhydride, as described, for example, in U.S. Pat. No. 3,172,892. A further discussion of hydrocarbyl-substituted succinic anhydrides can be found, for example, in U.S. Pat. Nos. 4,234,435; 5,620,486 and 5,393,309.

Polyalkenyl succinic anhydrides may be converted to polyalkyl succinic anhydrides by using conventional reducing conditions such as catalytic hydrogenation. For catalytic hydrogenation, a preferred catalyst is palladium on carbon. Likewise, polyalkenyl succinimides may be converted to polyalkyl succinimides using similar reducing conditions.

The polyalkyl or polyalkenyl substituent on the succinic anhydrides employed in the invention is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. Also, the mono-olefins can include propylene, butylene, particularly isobutylene, 1-octene and 1-decene. Polyolefins prepared from such mono-olefins include polypropylene, polybutene, polyisobutene, and the polyalphaolefins produced from 1-octene and 1-decene.

In one embodiment the polyalkyl or polyalkenyl substituent is one derived from polyisobutene. Suitable polyisobutenes for use in preparing the succinimide-acids of the present invention include those polyisobutenes that comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. Examples of suitable polyisobutenes having a high alkylvinylidene content include Ultravis™ 30, a polyisobutene having a number average molecular weight of about 1300 and a methylvinylidene content of about 74%, and Ultravis™ 10, a polyisobutene having a number average molecular weight of about 950 and a methylvinylidene content of about 76%, both available from British Petroleum, and materials comprising the beta isomer thereof.

The alpha-omega amino acids used in the present invention can be represented by the following generic formula:

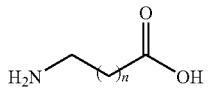

wherein 'n' is from 0 to 10, as taught in U.S. Pat. No. 6,548,458 which is incorporated herein by reference in its entirety.

Suitable alpha-omega amino acids include glycine, beta-alanine, gamma-amino butyric acid, 6-amino caproic acid, 11-amino undecanoic acid.

The molar ratio of anhydride to alpha-omega amino acid ranges from 1:10 to 1:1, preferably the molar ratio of anhydride to alpha-omega amino acid is 1:1.

The succinimide-acid compounds are typically prepared by combining the substituted-succinic anhydride and amino acid with a reaction media in a suitable reaction vessel. When the reaction media used is process oil, the reaction mixture is heated to between 120 and 180° C. under nitrogen. The reaction generally requires 2 to 5 hours for complete removal of water and formation of the succinimide product. When toluene (or other organic solvent) is used as the reaction media, the reflux temperature of the water/toluene (solvent) azeotrope determines the reaction temperature.

Reaction of the pendant carboxylic acid moiety of the succinimide-acid compound with an amine results in the formation of an amide bond. The reaction is conducted at a temperature and for a time sufficient to form the succinimide-amide reaction product. Typically, the reaction is conducted in a suitable reaction media such as an organic solvent, for example, toluene, or process oil. The reaction is typically conducted at a temperature of from 110 to 180° C. for 2 to 8 hours.

The ratio of succinimide-acid compound to polyamine ranges from n:1 to 1:1 where n is the number of reactive nitrogen atoms (i.e., unhindered primary and secondary amines capable of reacting with the succinimide-acid) within the polyamine.

In one embodiment the amines are polyamines and partially alkoxylated polyamines. Examples of polyamines that may be used include, but are not limited to, aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine is a mixture of polyalkylenepolyamines comprising small amounts of lower polyamine oligomers such as TEPA and PEHA but primarily oligomers with 7 or more nitrogens, 2 or more primary amines per molecule, and more extensive branching than conventional polyamine mixtures. Examples of a partially alkoxylated polyamines include aminoethylethanolamine (AEEA), aminopropyldiethanolamine (APDEA), diethanolamine (DEA) and partially propoxylated hexamethylenediamine (for example HMDA-2PO or HMDA-3PO). When partially alkoxylated polyamines are used, the reaction products of the succinimide-acid and the partially alkoxylated polyamine may contain mixtures of succinimide-amides and succinimide-esters as well as any unreacted components.

In one embodiment, the fuels will contain minor amounts of the triazine compounds that control, eliminate, or reduce formation of engine deposits, especially injector deposits and/or control soot formation. Generally speaking the fuels of the invention will contain an amount of the triazine compound sufficient to provide from about 0.0078 to about 0.25 gram of manganese per gallon of fuel, and preferably from about 0.0156 to about 0.125 gram of manganese per gallon.

Manganese Compound:

A manganese compound also can be added separately. For example, a non-limiting example of a useful manganese compound is an alkylcycloalkyldienyl manganese tricarbonyl, such as methylcyclopentadienyl manganese tricarbonyl. It generally is added in treat rates of about 0.0156 to about 0.125 gram of manganese per gallon of fuel.

Cyclopentadienyl manganese tricarbonyl compounds such as methylcyclopentadienyl manganese tricarbonyl are preferred combustion improvers because of their outstanding ability to reduce tailpipe emissions such as $NO_x$ and smog forming precursors and to significantly improve the octane quality of gasolines, both of the conventional variety and of the "reformulated" types.

Base Fuel:

The base fuels used in formulating the fuel compositions of the present invention include any base fuels suitable for use in the operation of spark-ignition internal combustion engines such as leaded or unleaded motor and aviation gasolines, and so-called reformulated gasolines which typically contain both hydrocarbons of the gasoline boiling range and fuel-soluble oxygenated blending agents ("oxygenates"), such as alcohols, ethers and other suitable oxygen-containing organic compounds. Preferably, the fuel in which the inventive additive is employed is a mixture of hydrocarbons boiling in the gasoline boiling range. This fuel may consist of straight chain or branch chain paraffins, cycloparaffins, olefins, aromatic hydrocarbons or any mixture of these. The gasoline can be derived from straight run naptha, polymer gasoline, natural gasoline or from catalytically reformed stocks boiling in the range from about 80° to about 450° F. The octane level of the gasoline is not critical and any conventional gasoline may be employed in the practice of this invention.

Oxygenates suitable for use in the present invention include methanol, ethanol, isopropanol, t-butanol, mixed C1 to C5 alcohols, methyl tertiary butyl ether, tertiary amyl methylether, ethyl tertiary butyl ether and mixed ethers. Oxygenates, when used, will normally be present in the base fuel in an amount below about 30% by volume, and preferably in an amount that provides an oxygen content in the overall fuel in the range of about 0.5 to about 5 percent by volume.

Carrier Fluids:

In another embodiment, the Mannich base products and the succinimides of this invention are used with a liquid carrier or induction aid. Such carriers can be of various types, such as for example liquid poly-alpha-olefin oligomers, mineral oils, liquid poly(oxyalkylene) compounds, liquid alcohols or polyols, polyalkenes, liquid esters, and similar liquid carriers. Mixtures of two or more such carriers can be employed.

Liquid carriers can include butane not limited to 1) a mineral oil or a blend of mineral oils that have a viscosity index of less than about 120, 2) one or more poly-alpha-olefin oligomers, 3) one or more poly(oxyalkylene) compounds having an average molecular weight in the range of about 500 to about 3000, 4) polyalkenes, 5) polyalkyl-substituted hydroxyaromatic compounds or 6) mixtures thereof. The mineral oil carriers that can be used include paraffinic, naphthenic and asphaltic oils, and can be derived from various petroleum crude oils and processed in any suitable manner. For example, the mineral oils may be solvent extracted or hydrotreated oils. Reclaimed mineral oils can also be used. Hydrotreated oils are the most preferred. Preferably the mineral oil used has a viscosity at 40° C. of less than about 1600 SUS, and more preferably between about 300 and 1500 SUS at 40° C. Paraffinic mineral oils most preferably have viscosities at 40° C. in the range of about 475 SUS to about 700 SUS. For best results, it is highly desirable that the mineral oil have a viscosity index of less than about 100, more preferably, less than about 70 and most preferably in the range of from about 30 to about 60.

The poly-alpha-olefins (PAO) which are included among the preferred carrier fluids are the hydrotreated and unhydrotreated poly-alpha-olefin oligomers, i.e., hydrogenated or unhydrogenated products, primarily trimers, tetramers and pentamers of alpha-olefin monomers, which monomers contain from 6 to 12, generally 8 to 12 and most preferably about 10 carbon atoms. Their synthesis is outlined in *Hydrocarbon Processing*, February 1982, page 75 et seq., and in U.S. Pat. Nos. 3,763,244; 3,780,128; 4,172,855; 4,218,330; and 4,950,822. The usual process essentially comprises catalytic oligomerization of short chain linear alpha olefins (suitably obtained by catalytic treatment of ethylene). The poly-alpha-olefins used as carriers will usually have a viscosity (measured at 100° C.) in the range of 2 to 20 centistokes (cSt). Preferably, the poly-alpha-olefin has a viscosity of at least 8 cSt, and most preferably about 10 cSt at 100° C.

The poly (oxyalkylene) compounds which are among the carrier fluids for use in this invention are fuel-soluble compounds which can be represented by the following formula $$R_1—(R_2—O)_n—R_3$$

wherein $R_1$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, $R_2$ is an alkylene group having 2-10 carbon atoms (preferably 2-4 carbon atoms), $R_3$ is typically a hydrogen, alkoxy, cycloalkoxy, hydroxy, amino, hydrocarbyl (e.g., alkyl, cycloalkyl, aryl, alkylaryl, aralkyl, etc.), amino-substituted hydrocarbyl, or hydroxy-substituted hydrocarbyl group, and n is an integer from 1 to 500 and preferably in the range of from 3 to 120 representing the number (usually an average number) of repeating alkyleneoxy groups. In compounds having multiple —$R_2$—O— groups, $R_2$ can be the same or different alkylene group and where different, can be arranged randomly or in blocks. Preferred poly (oxyalkylene) compounds are monools comprised of repeating units formed by reacting an alcohol with one or more alkylene oxides, preferably one alkylene oxide.

The average molecular weight of the poly (oxyalkylene) compounds used as carrier fluids is preferably in the range of from about 500 to about 3000, more preferably from about 750 to about 2500, and most preferably from above about 1000 to about 2000.

One useful sub-group of poly (oxyalkylene) compounds is comprised of the hydrocarbyl-terminated poly(oxyalkylene) monools such as are referred to in the passage at column 6, line 20 to column 7 line 14 of U.S. Pat. No. 4,877,416 and references cited in that passage, said passage and said references being fully incorporated herein by reference.

A preferred sub-group of poly (oxyalkylene) compounds is comprised of one or a mixture of alkylpoly (oxyalkylene) monools which in its undiluted state is a gasoline-soluble liquid having a viscosity of at least about 70 centistokes (cSt) at 40° C. and at least about 13 cSt at 100° C. Of these compounds, monools formed by propoxylation of one or a mixture of alkanols having at least about 8 carbon atoms, and more preferably in the range of about 10 to about 18 carbon atoms, are particularly preferred.

The poly (oxyalkylene) carriers used in the practice of this invention preferably have viscosities in their undiluted state of at least about 60 cSt at 40° C. (more preferably at least about 70 cSt at 40° C.) and at least about 11 cSt at 100° C. (more preferably at least about 13 cSt at 100° C.). In addition, the poly (oxyalkylene) compounds used in the practice of this invention preferably have viscosities in their undiluted state of no more than about 400 cSt at 40° C. and no more than about 50 cSt at 100° C. More preferably, their viscosities will not exceed about 300 cSt at 40° C. and will not exceed about 40 cSt at 100° C.

Preferred poly (oxyalkylene) compounds also include poly (oxyalkylene) glycol compounds and mono ether derivatives thereof that satisfy the above viscosity requirements and that are comprised of repeating units formed by reacting an alcohol or polyalcohol with an alkylene oxide, such as propylene oxide and/or butylene oxide with or without use of ethylene oxide, and especially products in which at least 80 mole % of the oxyalkylene groups in the molecule are derived from 1,2-propylene oxide. Details concerning preparation of such poly(oxyalkylene) compounds are referred to, for example, in Kirk-Othmer, *Encyclopedia of Chemical Technology*, Third Edition, Volume 18, pages 633-645 (Copyright 1982 by John Wiley & Sons), and in references cited therein, the foregoing excerpt of the Kirk-Othmer encyclopedia and the references cited therein being incorporated herein in toto by reference. U.S. Pat. Nos. 2,425,755; 2,425,845; 2,448,664; and 2,457,139 also describe such procedures, and are fully incorporated herein by reference.

The poly (oxyalkylene) compounds, when used, pursuant to this invention will contain a sufficient number of branched oxyalkylene units (e.g., methyldimethyleneoxy units and/or ethyldimethyleneoxy units) to render the poly (oxyalkylene) compound gasoline soluble.

Suitable poly (oxyalkylene) compounds for use in the present invention include those taught in U.S. Pat. Nos. 5,514,190; 5,634,951; 5,697,988; 5,725,612; 5,814,111 and 5,873,917, the disclosures of which are incorporated herein by reference.

The polyalkenes suitable for use in the present invention include polypropene and polybutene. The polyalkenes of the present invention preferably have a molecular weight distribution (Mw/Mn) of less than 4. In a preferred embodiment, the polyalkenes have a MWD of 1.4 or below. Preferred polybutenes have a number average molecular weight (Mn) of from about 500 to about 2000, preferably 600 to about 1000, as determined by gel permeation chromatography (GPC). Suitable polyalkenes for use in the present invention are taught in U.S. Pat. No. 6,048,373, which descriptions are incorporated herein by reference.

The polyalkyl-substituted hydroxyaromatic compounds suitable for use in the present invention include those compounds known in the art as taught in U.S. Pat. Nos. 3,849,085; 4,231,759; 4,238,628; 5,300,701; 5,755,835 and 5,873,917, the disclosures of which are incorporated herein by reference.

In some cases, the Mannich base detergent can be synthesized in the carrier fluid. In other instances, the preformed detergent is blended with a suitable amount of the carrier fluid. If desired, the detergent can be formed in a suitable carrier fluid and then blended with an additional quantity of the same or a different carrier fluid.

Optional Additives:

The fuel compositions of the present invention may contain supplemental additives in addition to the detergent(s) and the succinimides described above. Said supplemental additives include additional dispersants/detergents, antioxidants, carrier fluids, metal deactivators, dyes, markers, corrosion inhibitors, biocides, antistatic additives, drag reducing agents, demulsifiers, dehazers, anti-icing additives, anti-knock additives, anti-valve-seat recession additives, lubricity additives and combustion improvers.

The additives used in formulating the preferred fuels of the present invention can be blended into the base fuel individually or in various sub-combinations. However, it is preferable to blend all of the components concurrently using an additive concentrate as this takes advantage of the mutual compatibility afforded by the combination of ingredients when in the form of an additive concentrate. Also use of a concentrate reduces blending time and lessens the possibility of blending errors.

Other aspects of the present invention include fuels for spark-ignition engines into which have been blended small amounts of the various compositions of the invention described herein, as well as methods for reducing or minimizing injector deposits by fueling and/or operating the engine with the fuel composition of this invention.

EXAMPLES

The practice and advantages of this invention are demonstrated by the following examples, which are presented for purposes of illustration and not limitation. Unless indicated otherwise, all amounts, percentages and ratios are by weight.

Example 1

Fuels Containing Succinimide and Mannich Base Detergent

A series of engine tests were performed to assess the affect of succinimide and Mannich detergent combinations on deposit inhibition.

The Mannich detergents used were obtained as reaction products derived from the reaction of a long chain polyisobutylene-substituted cresol ("PBC"), N,N-dimethyl-1,3-propanediamine ("DMPD"), and formaldehyde ("FA").

The PBC was formed by reacting o-cresol with a polyisobutylene having an alkylvinylidene isomer content of less than 10% and a number average molecular weight of about 900. The PBC and DMPD were added to a resin kettle equipped with mechanized stirring, nitrogen feed, a Dean-Stark trap, and a heating mantle. Solvent, Aromatic 100 at 25% by weight of product, was introduced and the mixture was heated to 50° C. along with a slight exotherm. Next, 37% formaldehyde solution was added gradually, while vigorous stirring was maintained. A second, mild exotherm was noted. The reaction mixture was heated to reflux. The azeotropic blend of water and solvent was removed continuously over a period of approximately one hour. The temperature was increased as required to sustain removal of water, then the reaction mixture was heated gradually to 150° C., while sparging with nitrogen. After reaction the viscous product mixture was weighed and diluted with Aromatic 100 solvent as desired.

A Howell EEE fuel having a $T_{90}$ (° C.) of 160, an olefin content of 1.2% and a sulfur content of 20 ppm was used as the base fuel. A representative example of a suitable method of preparing the succinimide-amides suitable for use as fuel detergents is as follows:

A 2 L round bottom flask equipped with overhead stirrer, Dean Stark trap, was charged with 278.4 g of succinimide acid-4 and 20.4 g of dimethylaminopropylamine and 300 g of toluene. The mixture was stirred and heated at reflux. After 6 hours 3.2 mL of water was collected. The reaction mixture was concentrated in vacuo to afford 261 g of product with a succinimide acid:polyamine (DMAPA) ratio of 1:1. A similar reaction was performed using TETA polyamine to produce a succinimide acid:polyamine (TETA) ratio of 1:0.5. The treat rates for the Mannich detergent and succinimide are indicated in Table 3 below.

To demonstrate the effectiveness of the additive systems using the above-described fuel composition representing an embodiment of the present invention versus comparison fuel compositions in reducing deposits in direct injection gasoline engines, tests were conducted in a 1982 Nissan Z22e (2.2 liter) dual-sparkplug, four-cylinder engine modified to run in a homogeneous direct injection mode, at a fuel rich lambda of 0.8 to accelerate injector deposit formation.

Modifications to the engine included replacing the exhaust-side spark plugs with pre-production high-pressure common rail direct injectors, removing the OEM spark and fuel system, and installing a high-pressure fuel system and universal engine controller. Table 1 summarizes the specifications of the modified test engine. For homogeneous combustion, flat-top pistons and the conventional gasoline spark ignition combustion chamber design were found to be sufficient for this type of research work. The injectors were located on the hot (exhaust) side of the engine to favor high tip temperatures to promote injector deposit. With this engine set up, a six-hour injector deposit test was developed.

The rate of injector deposit formation was evaluated through the use of this specially developed steady-state engine test. Engine operating conditions for each test point were determined by mapping injector tip temperatures throughout the engine operating map range. The injectors were modified with thermocouples at the tip. Key parameters were inlet air and fuel temperatures, engine speed, and engine load. The inlet air and fuel temperatures were subsequently controlled at 35° C. and 32° C., respectively.

TABLE 1

| Test Engine Specifications | |
|---|---|
| Type | Four Cylinder In-Line 2.2 L L Nissan Engine Converted for DI Operation |
| Displacement | 2187 cubic centimeters |
| Plugs/cylinder | 1 (stock configuration: 2) |
| Valves/cylinder | 2 |
| Bore | 87 millimeters |
| Stroke | 92 millimeters |
| Fuel System | Common Rail High Pressure Direct Injection |
| Fuel Pressure | 6900 kPa (closed loop) |
| Engine Controller | Universal Laboratory System |
| Injection Timing | 300 degrees BTDC |
| Coolant Temperature (° C.) | 85 |
| Oil Temperature (° C.) | 95 |

At constant inlet air/fuel temperature and engine load, tip temperature remained constant at engine speeds of 1500, 2000, 2500, and 3000 rpm. However, at constant engine speed, tip temperatures increase with load. For the five load points, 200, 300, 400, 500, and 600 mg/stroke air charge, increasing tip temperatures of 120, 140, 157, 173, and 184° C., respectively, were observed for each load.

After numerous tests, it was determined that tip temperatures of 173° C. provide the optimum conditions for injector deposit formation. Table 2 sets forth the key test conditions used in performing the evaluation of the additives of the present invention.

TABLE 2

| Key Test Conditions | |
|---|---|
| Engine Speed (rpm) | 2500 |
| Inlet Air Temp. (° C.) | 35 |
| Inlet Fuel Temp. (° C.) | 32 |
| Exit Coolant Temp. (° C.) | 85 |
| Exit Oil Temp. (° C.) | 95 |
| Load (mg air/stroke) (° C.) | 500 |
| Injector Tip Temp. (° C.) | 173 |

The test is divided into three periods: engine warm-up, an operator-assisted period, and test period. Engine speed was controlled using the engine dynamometer controller, and the engine throttle was manipulated to control air charge using a standard automotive airflow meter as feedback in a closed-loop control system. Engine fueling was controlled in two ways. During warm-up, injector pulse width was controlled using a standard mass airflow strategy and exhaust gas sensor controlling the air/fuel mixture to stoichiometric. During the operator interaction period, the pulse width was manually set for each injector using wide-range lambda sensors in the exhaust port of each cylinder. Fuel flow was measured using a volumetric flow meter and a temperature-corrected density value was used to calculate mass flow. Ignition timing was held constant at 20° BTDC throughout the test. Inlet air temperature was controlled to 35 +/−2° C. and fuel temperature at the inlet to the high-pressure pump was controlled to 32 +/−2° C. Data were sampled ten times per second and averaged to form a record of all recorded parameters every ten seconds during the test.

Data acquisition began as soon as the engine was started. The engine idled for one minute before the speed was raised to 1500 rpm and the air charge (load) to 300 mg per stroke to warm the engine to operating temperature. During this 30-minute warm-up period coolant and oil temperatures were linearly raised from 40 to 85 +/−2° C. and 40 to 95 +/−2° C., respectively.

At the end of warm-up, engine speed was increased to 2500 rpm, and the air charge adjusted to the test target, which ranged from 100 to 600 mg air/stroke depending on the desired injector tip temperature. Within five minutes injector pulse width for each cylinder was manually adjusted to a lambda target value of 0.800 +/−0.005.

For the remainder of the test, pulse width, speed, and air charge remained constant. The change in fuel flow for the engine and the calculated change in fuel flow, based on lambda of each individual cylinder, were the measure of the injector flow decrease due to deposit formation.

Each fuel was run at a load condition of 500 mg/stroke. Injector deposit formation was followed by measuring total engine fuel flow at fixed speed, air charge (mass of air per intake stroke), and the lambda signal from each cylinder over a test period of six hours. To help minimize injector-to-injector variability the same set of injectors was used for all tests at a particular engine load, with each injector always in the same cylinder. Different sets of injectors, however, were used for different load conditions.

Gasoline fuel compositions were subjected to the above-described engine tests whereby the substantial effectiveness of these compositions in minimizing injector deposit formation was conclusively demonstrated. The detergent additives used and the percent flow loss for the fuels at tip temperatures of 173° C. are set forth in Table 3. In all of the examples containing a Mannich detergent, 27 ptb of a polyoxyalkylene monool carrier fluid was also added to the fuel composition.

TABLE 3

| Fuel Sample | Mannich Detergent (ptb) | Succinimide (ptb) | Flow loss (%) |
|---|---|---|---|
| | Percent flow loss | | |
| 1A* | 0 | 0 | 11.33 |
| 1B* | 31 | 0 | 5.33 |
| 1C* | 33 | 0 | 4.92 |
| 1 | 31 | 2 | 3.34 |

*comparison runs

Additional experiments were conducted using the same testing protocol as described above but using different Mannich detergents as summarized in Table 4.

TABLE 4

| Fuel Sample | Mannich Detergent Type | Mannich Detergent treat rate (ptb) | Succinimide Type | Succinimide treat rate (ptb) | Flow loss (%) |
|---|---|---|---|---|---|
| | | Percent flow loss | | | |
| 1D* | None | 0 | None | 0 | 13.1 |
| 1E* | Cresol M-1[1] | 60 | None | 0 | 9.0 |
| 1F* | None | 0 | H-4249[8] | 2 | 9.4 |
| 1G* | None | 0 | H-4249 | 2 | 8.8 |
| 2 | Cresol M-2[2] | 58 | H-4249 | 2 | 3.3 |
| 3 | Cresol M-3[2] | 49 | H-4249 | 11 | 4.9 |
| 4 | Cresol M-4[2] | 38 | H-4249 | 22 | 5.7 |
| 5 | Cresol M-5[2] | 29 | H-4249 | 31 | 8.0 |
| 6 | Cresol M-6[2] | 58 | EC203376[9] | 1.5 | 5.5 |
| 1H* | DBAM[7] | 80 | none | 0 | 14.7 |
| 7 | DBAM | 80 | H-9645[10] | 3.0 | 4.4 |
| 1I* | None | 0 | H-9645 | 29.0 | 4.4 |

*comparison runs
[1]33 ptb Cresol detergent
[2]31 ptb Cresol detergent
[3]22 ptb Cresol detergent
[4]11 ptb Cresol detergent
[5]33 ptb Cresol detergent
[6]33 ptb Cresol detergent
[7]DBAM was the reaction product of PIB cresol, dibutylamine and formaldehyde.
[8]Succinimide additive H-4249 was prepared from a 950 MW PIB, succinic anhydride, TETA/E100 polyethylene amine mixture at a PIBSA/amine ratio of 1.6:1.
[9]The reaction product of 900 MW PBSA with aminocaproic acid and dimethylaminopropylamine.
[10]Succinimide additive H-9645 was prepared from the reaction of PIBSA and TEPA (1.6:1.0) with 10% process oil.

Example 2

Fuels Containing Succinimide and Polyetheramine Detergent

To demonstrate the effectiveness of the additive systems using fuel compositions containing succinimide and polyetheramine detergent according to another embodiment of this invention in reducing deposits in direct injection gasoline engines, additional tests were conducted using the same engine testing system as described in Example 1.

In the experiments conducted that are summarized in Table 5, the base fuel was Howell EEE fuel as described above, the polyetheramine additive (PEA Additive) was made from cyanoethylation of a butoxylated dodecylphenol reduced with hydrogen. The succinimide additive was H-4249.

TABLE 5

PEA Enhancement With Succinimide Top Treat for DIG Injector Performance

| Fuel Sample | PEA Additive Treat rate (ptb) | Succinimide Additive Treat rate (ptb)(H-4249) | Flow Loss after 6 hrs (%) |
|---|---|---|---|
| 2A* | 0 | 0 | 13.1 |
| 2B* | 60 | 0 | 10.8 |
| 8 | 60 | 2 | 6.9 |
| 9 | 80 | 2 | 7.9 |
| 10 | 10 | 2 | 7.2 |

*comparison runs

Additional experiments were conducted using the same protocol as above but using a different succinimide compound are summarized in Table 6, in which the base fuel and polyetheramine additive (PEA additive) were the same but the succinimide additive used was instead the reaction product of 900 MW PBSA with aminocaprioc acid and dimethylaminopropylamine ("EC203376").

TABLE 6

PEA Enhancement With Succinimide Top Treat for DIG Injector Performance

| Fuel Sample | PEA Additive Treat rate (ptb) | Succinimide Additive Treat rate (ptb) | Flow Loss after 6 hrs (%) |
|---|---|---|---|
| 2C* | 0 | 0 | 13.1 |
| 2D* | 60 | 0 | 10.8 |
| 11 | 60 | 2 | 8.7 |
| 12 | 20 | 2 | 5.2 |
| 13 | 100 | 2 | 6.6 |

*comparison runs

Further experiments were conducted using the same protocol as above but using a 12 hour flow loss test instead of the six hour test, and a different polyetheramine and different succimide compounds as summarized in Table 7, in which the polyetheramine additive (PEA additive) was the same as in Table 5. The Succinimide additives were a reaction product of either an alkyl succinic anhydride (ASA) and tetraethylene pentamine (TEPA), or alternatively of PIBSA and TEPA.

TABLE 7

PEA Enhancement With Succinimide Top Treat for DIG Injector Performance

| Fuel Sample | PEA Additive Treat rate (ptb) | Succinimide Additive Treat rate (ptb) | Flow Loss after 12 hrs (%) |
|---|---|---|---|
| 2E* | 0 | 0 | 20.0 |
| 2F* | 60 | 0 | 14.6 |
| 14 | 57 | 3 | 2.0 |
| 15 | 57 | 3 | 5.5 |
| 16 | 57 | 3 | 7.9 |
| 17 | 57 | 3 | 7.2 |

*comparison runs

Example 3

Fuels Containing Manganese Compound and Polyetheramine Detergent

To demonstrate the effectiveness of the additive systems using fuel compositions containing polyetheramine detergent and a manganese deposit inhibitor according to another embodiment of this invention in reducing deposits in direct injection gasoline engines, additional tests were conducted using the same engine testing system as described in Example 1.

A fuel composition was formulated with a Mannich detergent and a manganese compound. The manganese compound added was methylcyclopentadienyl manganese tricarbonyl (MMT). 1: The detergent used was a Mannich detergent/carrier fluid mixture prepared as taught in U.S. Pat. No. 5,725,612, Example 6, Table 2. A Howell EEE fuel having a $T_{90}$ (° C.) of 160, an olefin content of 1.2% and a sulfur content of 20 ppm was used as the base fuel.

The treat rates of the Mannich detergent and manganese compound are indicated in Table 8 below.

Gasoline fuel compositions were subjected to the above-described engine tests whereby the substantial effectiveness of these compositions in minimizing injector deposit formation in direct injection gasoline engines was conclusively demonstrated. The percent flow loss for the fuels at tip temperatures of 173° C. are set forth in Table 8.

TABLE 8

Percent flow loss

| Fuel Sample | MMT (g Mn/gallon) | Detergent (ptb) | Flow loss (%) |
|---|---|---|---|
| 3A* | 0 | 0 | 10.24 |
| 3B* | 1/64 | 0 | 5.37 |
| 3C* | 1/32 | 0 | 6.26 |
| 3D* | 0 | 60 | 4.33 |
| 18 | 1/64 | 60 | 4.16 |
| 19 | 1/32 | 60 | 2.91 |

*Comparison runs

It is clear from examination of Table 8 that the fuel compositions containing a combination of detergent and manganese compounds added to fuels for use in direct injection gasoline engines provides unexpected improvements (reductions) in injector deposits when added to the base fuel as well as improving the effectiveness of a detergent in reducing injector deposits.

It is to be understood that the reactants and components referred to by chemical name anywhere in the specification or claims hereof, whether referred to in the singular or plural, are identified as they exist prior to coming into contact with another substance referred to by chemical name or chemical type (e.g., base fuel, solvent, etc.). It matters not what chemical changes, transformations and/or reactions, if any, take place in the resulting mixture or solution or reaction medium as such changes, transformations and/or reactions are the natural result of bringing the specified reactants and/or components together under the conditions called for pursuant to this disclosure. Thus the reactants and components are identified as ingredients to be brought together either in performing a desired chemical reaction (such as a Mannich condensation reaction) or in forming a desired composition (such as an additive concentrate or additized fuel blend). It will also be recognized that the additive components can be added or blended into or with the base fuels individually per se and/or as components used in forming preformed additive combinations and/or sub-combinations. Accordingly, even though the claims hereinafter may refer to substances, components and/or ingredients in the present tense ("comprises", "is", etc.), the reference is to the substance, components or ingredient as it existed at the time just before it was first blended or mixed with one or more other substances, components and/or ingredients in accordance with the present disclosure. The fact that the substance, components or ingredient may have lost its original identity through a chemical reaction or transformation during the course of such blending or mixing operations is thus wholly immaterial for an accurate understanding and appreciation of this disclosure and the claims thereof.

As used herein the term "fuel-soluble" or "gasoline-soluble" means that the substance under discussion should be sufficiently soluble at 20° C. in the base fuel selected for use to reach at least the minimum concentration required to enable the substance to serve its intended function. Preferably, the substance will have a substantially greater solubility in the base fuel than this. However, the substance need not dissolve in the base fuel in all proportions.

At numerous places throughout this specification, reference has been made to a number of U.S. Patents and published foreign patent applications. All such cited documents are expressly incorporated in full into this disclosure as if fully set forth herein.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

We claim:

1. A method for operating a direct injection gasoline engine on an unleaded fuel composition, the method comprising: supplying a fuel composition comprising:

(a) a spark-ignition fuel (b) a Mannich base detergent;

(c) a succinimide compound, wherein the Mannich base detergent and succinimide compound are present in a ratio of detergent to succinimide of from about 16:1 to about 1000:1 by weight; and (d) a manganese compound; and introducing into the direct injection gasoline engine, with the combustion intake charge, the fuel composition.

2. The method as described in claim 1, wherein the manganese compound comprises a fuel-soluble cyclopentadienyl manganese tricarbonyl compound.

* * * * *